US006569290B2

(12) United States Patent
Johnson

(10) Patent No.: US 6,569,290 B2
(45) Date of Patent: May 27, 2003

(54) BI-COMPONENT MOLDED MODULAR LINK AND A FABRIC MADE FROM A PLURALITY THEREOF

(75) Inventor: C. Barry Johnson, Mt. Pleasant, SC (US)

(73) Assignee: AstenJohnson, Inc., Charleston, SC (US)

( * ) Notice: Subject to any disclaimer, the term of this patent is extended or adjusted under 35 U.S.C. 154(b) by 0 days.

(21) Appl. No.: 10/078,177

(22) Filed: Feb. 19, 2002

(65) Prior Publication Data

US 2002/0116839 A1 Aug. 29, 2002

Related U.S. Application Data

(63) Continuation of application No. PCT/US00/22751, filed on Aug. 18, 2000.
(60) Provisional application No. 60/150,069, filed on Aug. 20, 1999.

(51) Int. Cl.[7] ..... D21F 7/12
(52) U.S. Cl. ..... 162/348; 162/358.2; 162/900; 162/902; 34/660; 428/101; 428/134; 428/137
(58) Field of Search ..... 162/205, 206, 162/348, 358.1, 358.2, 358.4, 359.1, 361, 362, 900–904; 428/33, 58–60, 101, 131, 134, 137; 198/850–853, 844.1, 844.2; 34/660, 116, 120; 139/383 A, 383 AA, 425

(56) References Cited

U.S. PATENT DOCUMENTS

| | | | | |
|---|---|---|---|---|
| ,500,521 A | | 6/1893 | Wickers | |
| 1,663,298 A | | 3/1928 | Geer et al. | |
| 1,925,917 A | | 9/1933 | Chalon | |
| 3,121,660 A | | 2/1964 | Hall, Jr. | |
| 3,262,549 A | | 7/1966 | Stewart et al. | |
| 3,920,117 A | | 11/1975 | Roinestad | 198/194 |
| 4,050,323 A | | 9/1977 | I'Anson | 74/251 C |
| 4,140,025 A | | 2/1979 | Lapeyre | 74/255 R |
| 4,159,763 A | | 7/1979 | Kewley et al. | 198/853 |
| 4,170,281 A | | 10/1979 | Lapeyre | 198/844 |
| 4,186,566 A | | 2/1980 | Au Young | 62/380 |
| 4,394,901 A | * | 7/1983 | Roinestad | 198/850 |
| 4,469,221 A | | 9/1984 | Albert | 198/851 |

(List continued on next page.)

FOREIGN PATENT DOCUMENTS

| | | | | |
|---|---|---|---|---|
| DE | 3735709 A1 | | 5/1989 | |
| EP | 0250421 B1 | | 9/1990 | |
| EP | 0763623 A1 | | 3/1997 | |
| EP | 0802280 A2 | | 10/1997 | |
| GB | 2 254 288 | * | 10/1992 | B32B/3/24 |
| WO | WO9202677 | | 2/1992 | |
| WO | WO9217643 | | 10/1992 | |

OTHER PUBLICATIONS

INTRALOX Brochure—Modular Plastic Conveyor Belts, 1995.

*Primary Examiner*—Steven P. Griffin
*Assistant Examiner*—Eric J Hug
(74) *Attorney, Agent, or Firm*—Volpe and Koenig, P.C.

(57) ABSTRACT

A bi-component link for making a modular papermaking fabric has a link base component capable of interconnecting to at least one other link and a surface plate component attached to the link base forming a paper support surface. Each component is made through molding techniques to have predetermined characteristics such as open area, permeability, surface finish, etc. The surface plate component is attached to the link base component for combined effect on fabric characteristics. A papermaking fabric is constructed from a plurality of interconnected bi-component links and has predetermined permeability established by the combination of a pattern of open and contact areas on each component of each link.

19 Claims, 14 Drawing Sheets

U.S. PATENT DOCUMENTS

| | | | | | |
|---|---|---|---|---|---|
| 4,537,658 | A | * | 8/1985 | Albert | 162/348 |
| 4,541,895 | A | * | 9/1985 | Albert | 162/348 |
| 4,575,472 | A | | 3/1986 | Lefferts | 428/222 |
| 4,579,771 | A | | 4/1986 | Finn et al. | 428/222 |
| 4,842,905 | A | | 6/1989 | Stech | 428/33 |
| 4,993,543 | A | | 2/1991 | Lapeyre | 198/834 |
| 5,004,097 | A | | 4/1991 | Roinestad et al. | 198/803.01 |
| 5,101,966 | A | | 4/1992 | Lapeyre | 198/803.14 |
| 5,125,504 | A | * | 6/1992 | Corlett et al. | 198/850 |
| 5,197,591 | A | | 3/1993 | Roinestad et al. | 198/803.01 |
| 5,213,203 | A | | 5/1993 | Kinney et al. | 198/850 |
| 5,215,185 | A | | 6/1993 | Counter et al. | 198/853 |
| 5,253,749 | A | | 10/1993 | Ensch | 198/850 |
| 5,303,818 | A | | 4/1994 | Gruettner et al. | 198/850 |
| 5,310,045 | A | | 5/1994 | Palmaer et al. | 198/778 |
| 5,330,604 | A | | 7/1994 | Allum et al. | 156/304.7 |
| 5,372,248 | A | | 12/1994 | Horton | 198/852 |
| 6,402,895 | B1 | * | 6/2002 | Best | 162/358.2 |
| 6,436,240 | B1 | * | 8/2002 | Jeffrey | 162/358.2 |

* cited by examiner

FIG. 8
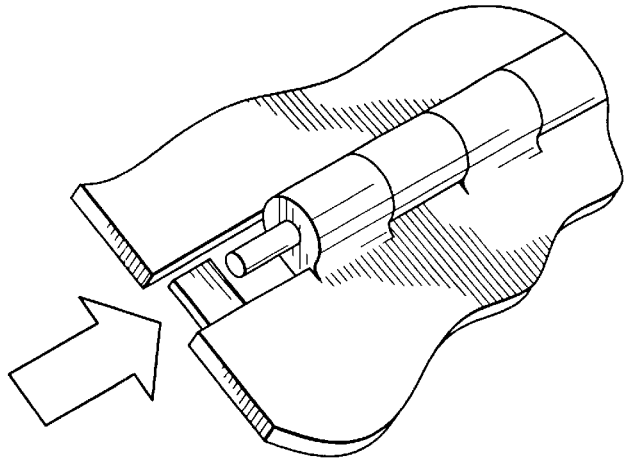
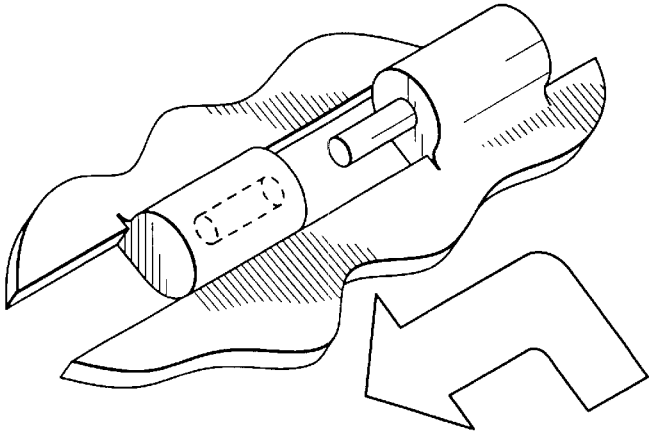
FIG. 9
FIG. 10
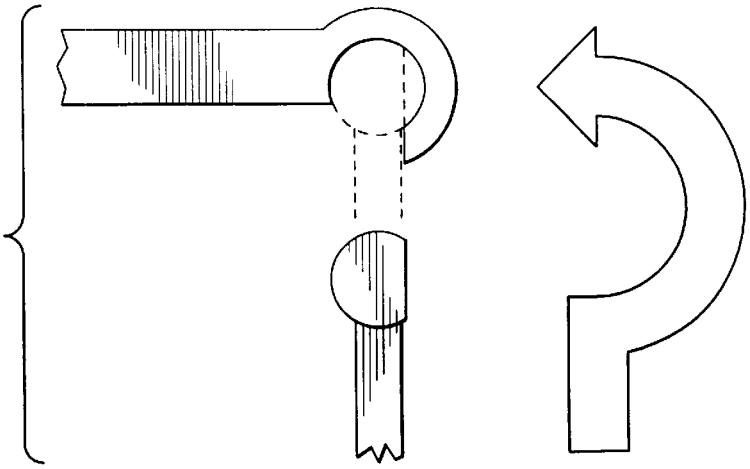

BI-COMPONENT MOLDED MODULAR LINK AND A FABRIC MADE FROM A PLURALITY THEREOF

CROSS-REFERENCE TO RELATED APPLICATIONS

This application is a continuation of PCT/US00/22751, filed Aug. 18, 2000, which claims the benefit of U.S. Provisional Application 60/150,069, filed Aug. 20, 1999, both of which are incorporated by reference herein as if fully set forth.

BACKGROUND

The present invention relates to papermaking fabrics, especially dryer fabrics. More specifically it relates to fabrics made from interconnected modular subassemblies. Most specifically it relates to pre-molded, bi-component subassembly links used to make a modular fabric.

A papermaking fabric is used in the form of an endless belt which is supported by and advanced through the papermaking machine by various machine rolls. The process and the various sections of the machine, forming, press and dryer, will be known to those skilled in the art.

Traditionally, fabrics have been made either through endless or flat weaving techniques. More recently, spiral fabrics have been made by connecting spiral coils with pintles to create a fabric. The spiral fabrics allow for greater flexibility in making fabrics of various dimensions because, unlike flat or endless woven fabrics whose dimensions must be known ahead of time, they are not limited by loom design. Spiral fabric, however, lacks adaptability with regard to desired changes in drainage, permeability and surface characteristics.

Papermaking fabrics, especially dryer fabrics, commonly comprise woven monofilament yarns. The monofilaments have traditionally been extruded from materials such as nylon, polyester, etc. Unfortunately, the extrusion process renders many plastics unsuitable for use in the harsh dryer section environment. Therefore, the choice of materials suitable for use in forming the monofilament has been limited. Many more plastics would become available if a dryer fabric could be made with molding techniques. To date, few practical mechanisms exist for constructing fabrics from molded parts.

One prior attempt at forming a dryer fabric for a paper machine from molded components is described in DE 37 35 709 A1. This reference discloses flat plastic elements which are interconnected by pintles or articulated joints, with the spacing of the elements and the size of the apertures therethrough being selected to provide a desired air permeability for the fabric. However, each of the molded components extends across an entire width of the fabric and there is no teaching of the necessary features to successfully practice the invention in connection with commercial papermaking dryer fabrics, which typically have a width of 10 meters (30 feet). There is also no suggestion as to how such molded components, which extend across an entire fabric could be economically manufactured and assembled, or of molded subassemblies having a width smaller than the entire fabric width or a manufacturable aspect ratio and thicknesses for such subassemblies which can be assembled together to form a dryer fabric. Additionally, this references teaches punched or stamped through openings which are formed in the flat elements or in the fabric after it is assembled. Therefore, if fabrics having different permeabilities are desired, a different number or size of openings would have to be punched or stamped in the flat elements because there is no suggestion of a bi-component assembly wherein the base and surface components are linked together through the plane of the fabric and the air permeability of the resulting fabric is determined by the overlapping alignment of the apertures in the first layer relative to the second layer such that the same components can be assembled to produce different permeability fabrics. Punching or stamping the openings also introduces additional processing cost as well as increased potential for damage to the pintles.

U.S. Pat. No. 4,579,771 discloses a laminated spiral mesh papermakers fabric having a base layer formed from a plurality of intermeshed monofilament spiral coils which are joined together with pintles. An upper layer, such as a felt batt or a molded sheet of plastic having apertures cut or punched therethrough, is attached to the base layer using an adhesive.

Present dryer fabrics form endless belts passing around rollers having diameters from 18 to 60 in. (45.7 to 152.4 cm). While flexibility is an important requirement, fabrics also must be strong enough to support the paper web along its path under a variety of conditions and temperatures. Suggested load capacities have been fifteen pounds per linear inch (PLI) (267.9 kg/m). The fabric must also withstand traveling at speeds greater than 4,000 feet per minute (1219.2 m/min).

Damage and dirt accumulation are also major factors which typically limit the maximum useful life of the fabric. Fabric edges are particularly vulnerable because of a tendency of the yarns to unravel and shift. Once damaged, the entire fabric must be replaced. Although traditional woven fabrics have been limited in size by loom construction, they have still reached as much as thirty feet wide by three hundred feet long. Damage to even a small area of the fabric necessitates costly replacement of the entire fabric.

Even minor marring of the surface may deteriorate fabric quality because the paper contact surface characteristics greatly affect the final paper product. Traditional fabrics adjust these characteristics through choice of materials and the type of weave used. Often, a compromise between the best material or the best weave and final product quality must be made. Batting or other material has been affixed to the paper support surface to gain benefits not available from standard materials and weaves. A molded fabric also offers greater flexibility in this regard, as surface characteristics may be incorporated directly into the mold and repeated consistently throughout the fabric. Even more flexibility is added when a separate molded surface plate is attached to a molded base fabric. A removable and replaceable surface plate opens up new flexibility in choosing and maintaining surface characteristics.

The use of molded fabrics will benefit the art in many ways. A more direct process, avoiding additional storage and coiling requirements of monofilament yarns, as well as reducing trimming time and eliminating sealing will be enjoyed by using molded fabrics. More choices of less expensive material will become available, including lower molecular weight materials and gels having less stringent filtration requirements. The molding process also allows the use of composite materials to achieve more beneficial physical properties while maintaining cost effectiveness. A molded fabric allows greater flexibility and efficiency in design when creating fabric patterns (i.e., weave patterns and fabric dimensions). A fabric assembled from pre-molded subassemblies is strong, dimensionally stable, thermally stable, easy to join, distortion free, and has tough finished edges. Furthermore, use of a molded fabric limits fabric stretch, reduces costs, facilitates repair and generally benefits the papermakers art.

SUMMARY

The present invention is a pre-molded, bi-component subassembly for constructing papermaking fabrics. A surface component may be attached to a base component for combined effects on the final paper product. A plurality of the subassemblies are interconnected to create an endless fabric. The completed fabric operates as a papermaking carrier surface in any of the known machine positions.

BRIEF DESCRIPTION OF THE DRAWINGS

FIG. 8 is a perspective view of a pintle system for interconnecting the subassembly links of the present invention.

FIG. 9 is a perspective view of a pin lock system for interconnecting the subassembly links of the present invention.

FIG. 10 is a side elevational view of a D-link system for interconnecting the subassembly links of the present invention.

DETAILED DESCRIPTION OF THE PREFERRED EMBODIMENTS

Throughout the figures of the various embodiments of the present invention, like elements are identified with the same numerals.

Figure 1:
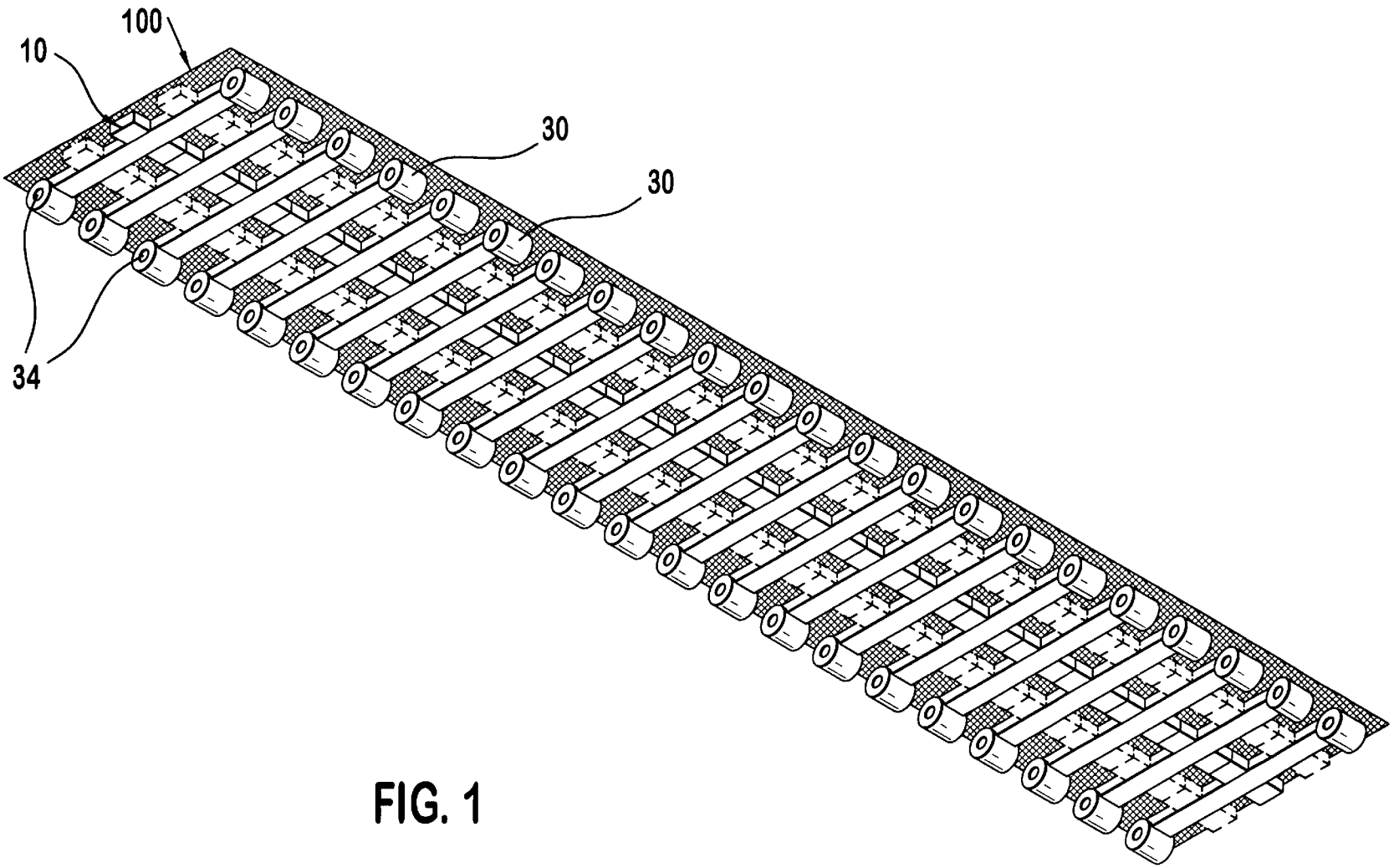
FIG. 1 is a perspective view of the machine side of a bi-component link of the present invention.
Figure 2:
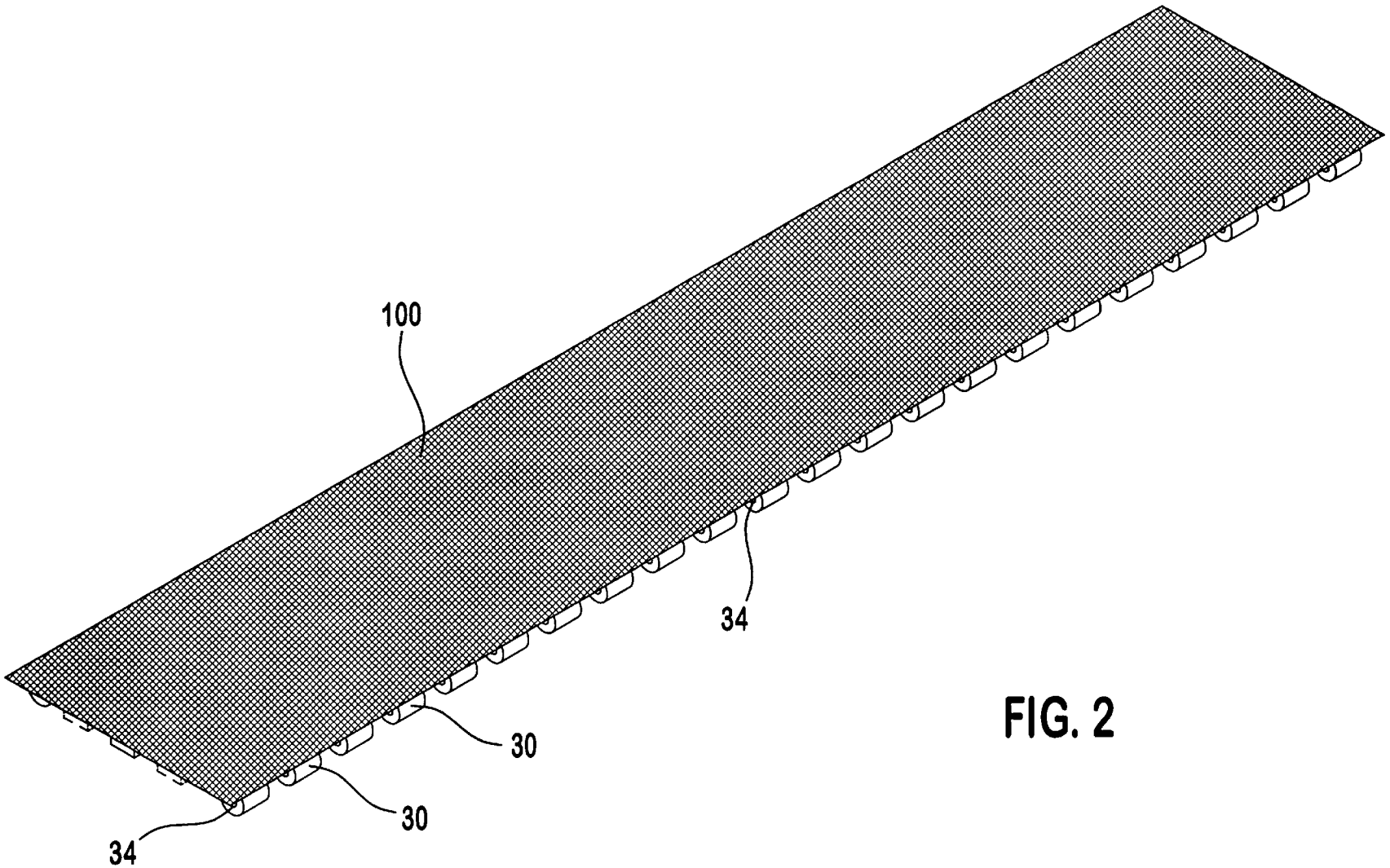
FIG. 2 is a perspective view of the sheet side of a bi-component link of the present invention.

The invention may be described generically as comprising a pliable, modular link base 10 and an attached modular surface plate component 100, as shown in FIGS. 1 and 2. Both components are molded using techniques that are well known in the art. The link base 10 has a planar upper support surface 20 to which the surface plate 100 is attached, preferably removably. The surface plate 100 is designed to carry the paper web and is molded to have a predetermined open area or permeability, based upon machine and product demands. Finally, the link base 10 is provided with means for interconnecting it with other links to form an endless papermaking fabric. The completed fabric will be made of a plurality of interconnected link bases 10. Preferably, each has an attached surface plate 100. Alternatively, a single surface plate may cover a plurality of link bases.

Materials and dimensions are chosen for a combination of reasons taking into account fabric demands and tooling concerns. Generally, the molding characteristics and mechanical strength and chemical resistance abilities are important in material selection. Nylon 6/6 material, available from Dupont under the trademark Zytel®, is useful because of its desirable properties of strength, flexibility, impact resistance, heat performance and good mold processability. Other materials and specialized higher heat grades of resin maybe used.

Figure 16:
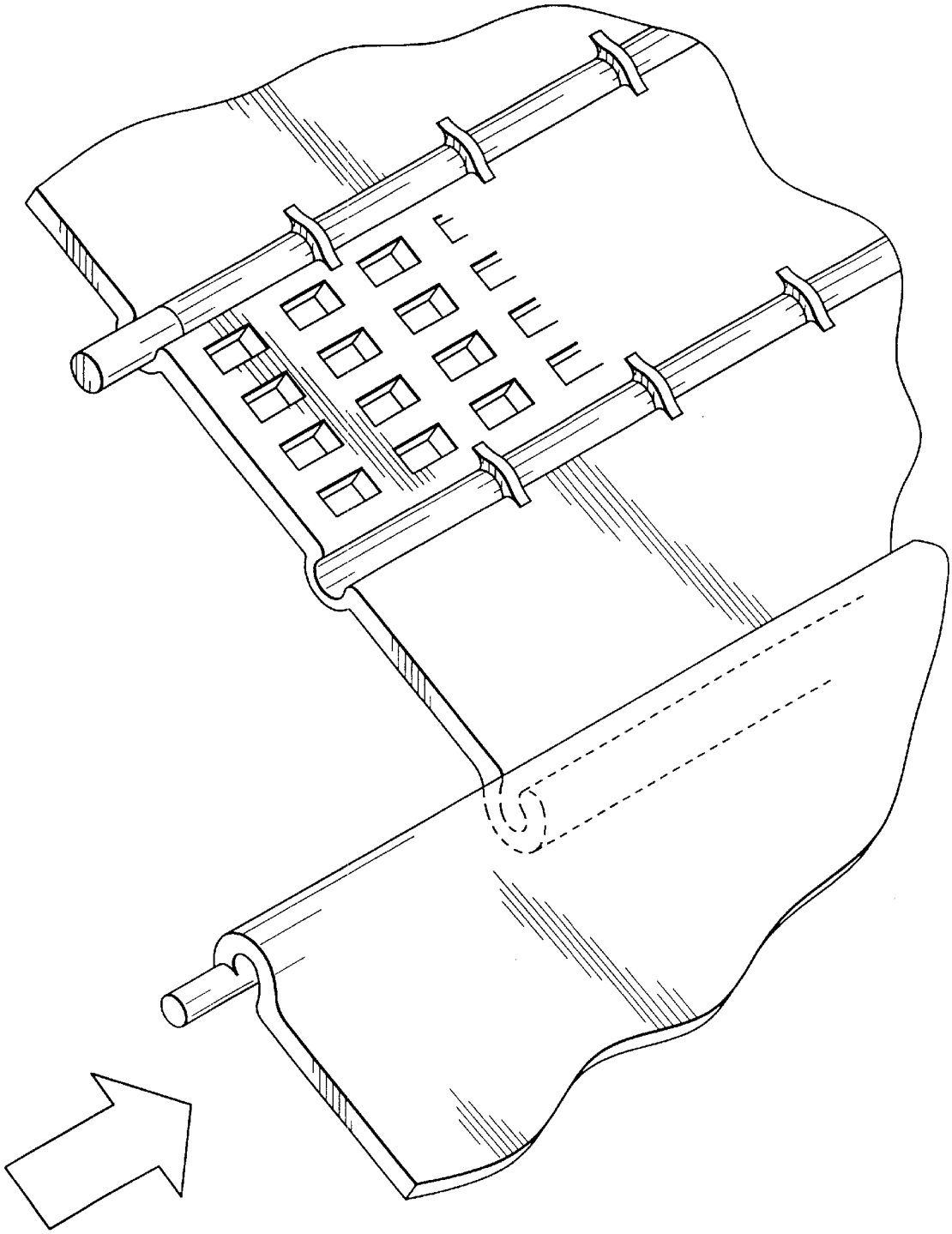
FIG. 16 is a perspective view of a alternative link base with a sliding lock system for interconnecting the subassembly links of the present invention.
Figure 17:
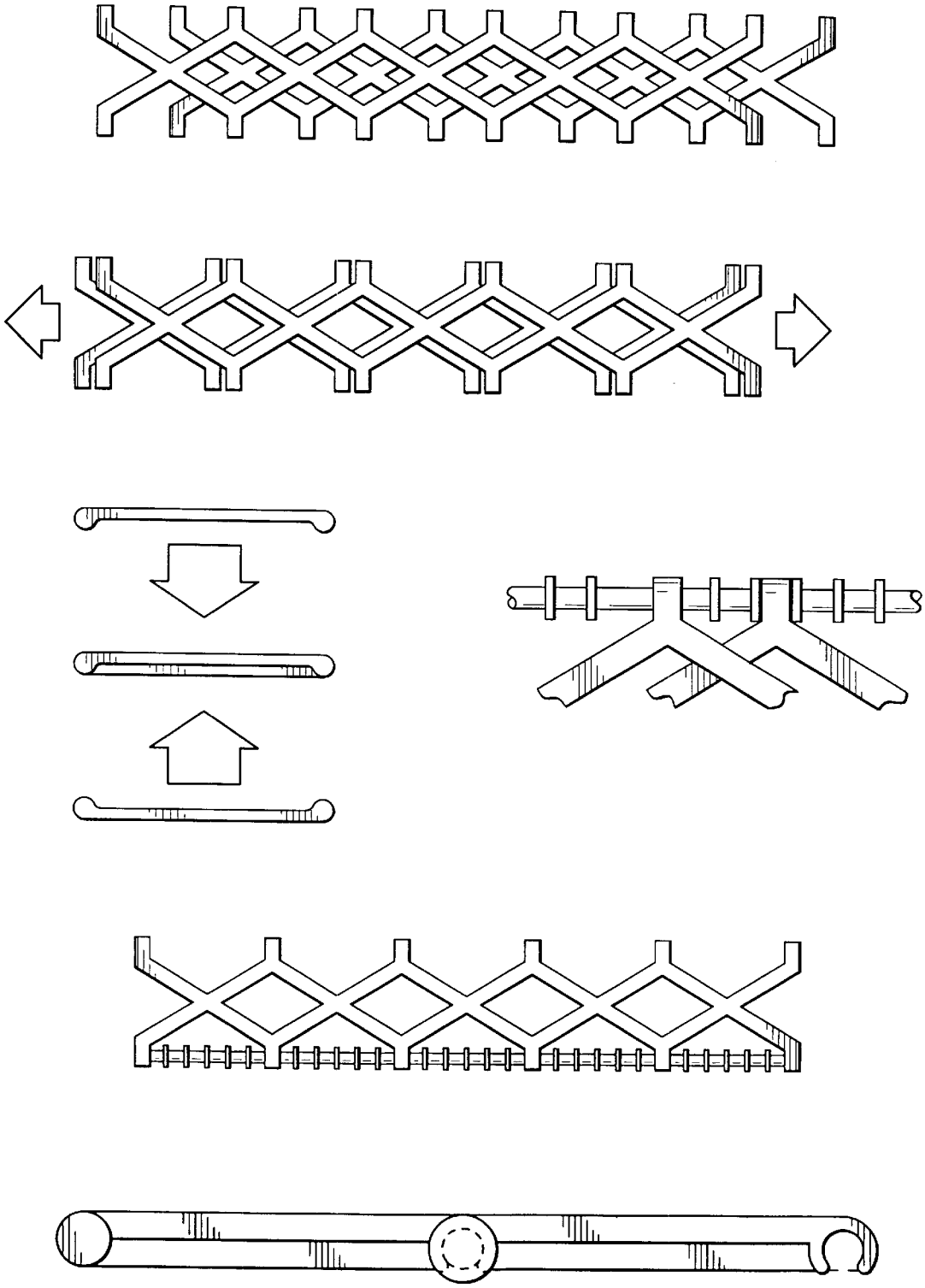
FIG. 17 is a plan view of an alternative bi-component link of the present invention.
Figure 18:
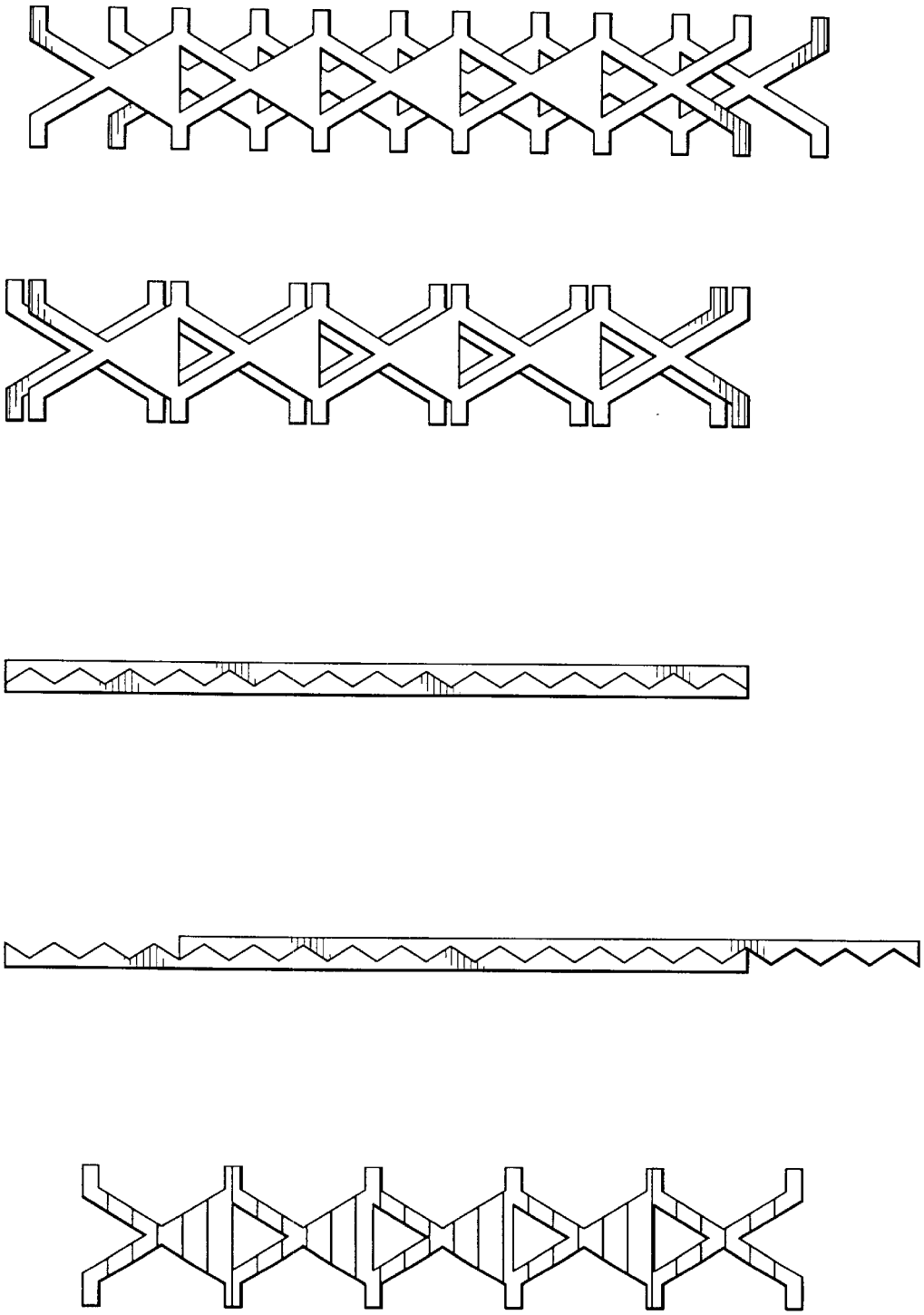
FIG. 18 is a plan view of an alternative bi-component link of the present invention.

Along with choice of material, the actual link dimensions, interconnection means, and "weave pattern" must be determined according to fabric and tooling demands. The link dimensions have been found to be more limited by practical tooling and molding considerations than by fabric considerations. Interconnection means, such as those illustrated in FIGS. 8–18, include a pintle system, integrated pin locks, D-link and finger locks, snap supports, grip linkages, and lock-fit mechanisms. The "weave pattern" must be chosen with fabric considerations in mind, but is limited only by mold construction and paper marking considerations. It may take a variety of patterns such as the gingham-type pattern shown in FIGS. 3–6 or the alternative structures shown in FIGS. 16–18. The latter figures show a flexible matt-like structure and adjustable X-weave patterns which slide atop each other for adjusting permeability in the finished fabric.

The link base 10 described below was developed for use in a corrugated paper process. In the process, the completed fabric wraps around rollers having 18 inch (45.72 cm) and 60 inch (152.4 cm) diameters. A maximum temperature of 300° F. (148.9° C.) is estimated at the fabric as it travels over steam cans having estimated temperatures up to 400° F (204.4° C.). This temperature differential is due to the layer of paper pulp that separates, the fabric from the steam cans. Typically, woven fabrics used in this process have a thickness of 0.140 inch (3.56 mm) and weigh approximately 5.9 oz./ft.$^2$ (1.8 kg/m$^2$). Normal running tension load on the fabric ranges from 8–15 PLI (142.9–267.9 kg/m), however, higher loads may be caused when a pulp wad passes through the rollers. Fabric thickness of the new modular fabric should approximate existing fabric thickness and, ideally, reduce weight. Since current seam strengths in woven fabrics presently range between 200–300 PLI (3572–5358 kg/m), 500 PLI (8930 kg/m) was the goal for the present example.

Figure 3:
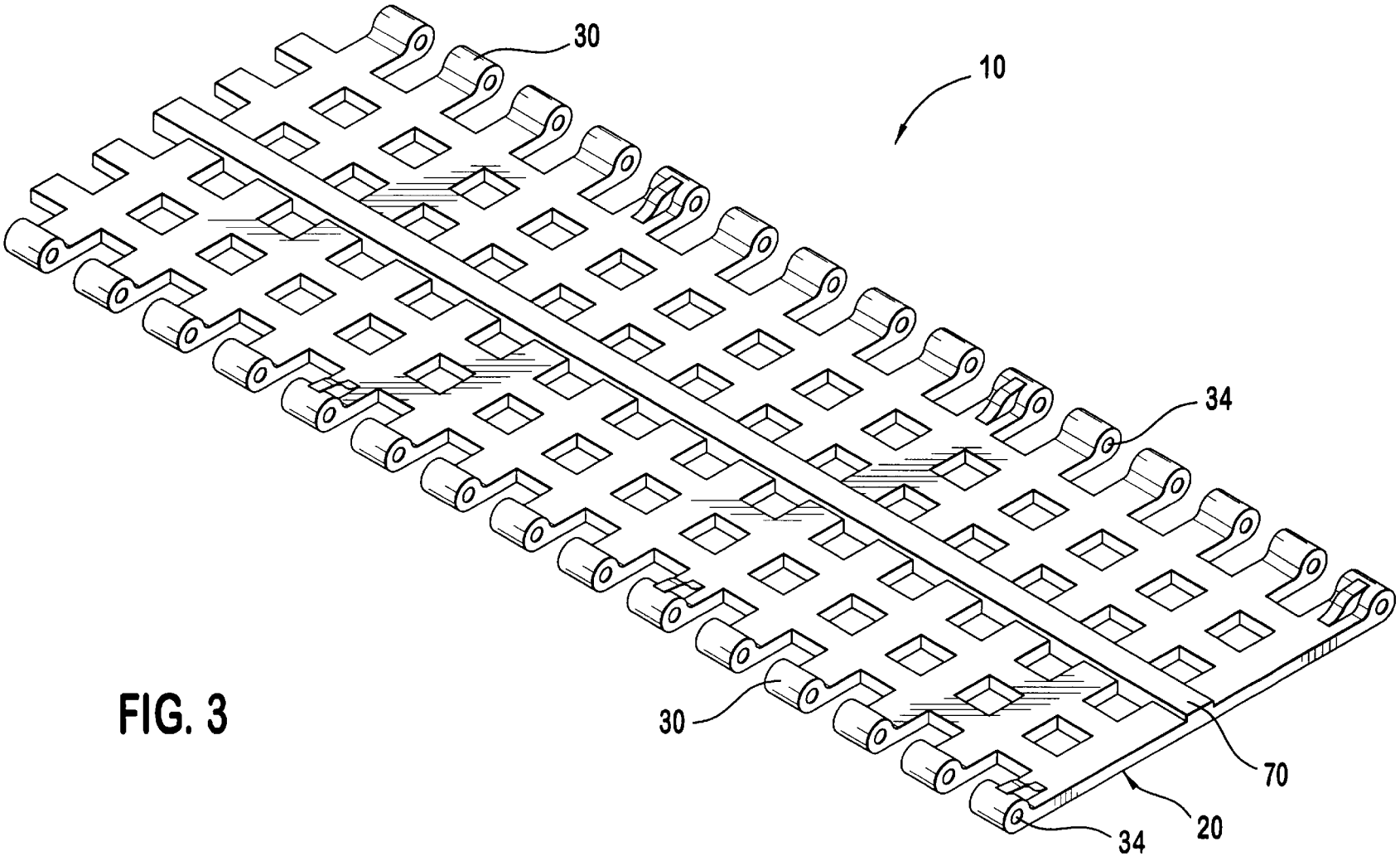
FIG. 3 is a perspective view of the machine side of a link base of the present invention.

Keeping those requirements in mind, the link base 10 was constructed generally as shown in FIGS. 3–6. As seen in FIG. 3, link base 10 was molded in a generally rectangular shape having a major axis and a minor axis. The major axis relates generally to the cross-machine direction in the papermaking machine while the minor axis relates to the machine direction. A pintle system similar to that shown in FIG. 8 was chosen as the interconnection means due to its inherent strength. A plurality of individual pintle links 30 project from the two sides of the link base 10 parallel to the major axis, each defining a bearing area 32 and pintle hole 34. Each pintle hole 34 is aligned with the next to form part of a pintle channel running parallel to the major axis along the length of each side. A pintle inserted through a completed pintle channel formed by interdigitating individual pintle links 30 of adjacent link bases 10 is used to interconnect a plurality of the link bases 10 to make a complete fabric. Each link base 10 has an upper surface 20 which defines a planar support surface for contacting and carrying the paper web through the paper machine.

Figure 4:
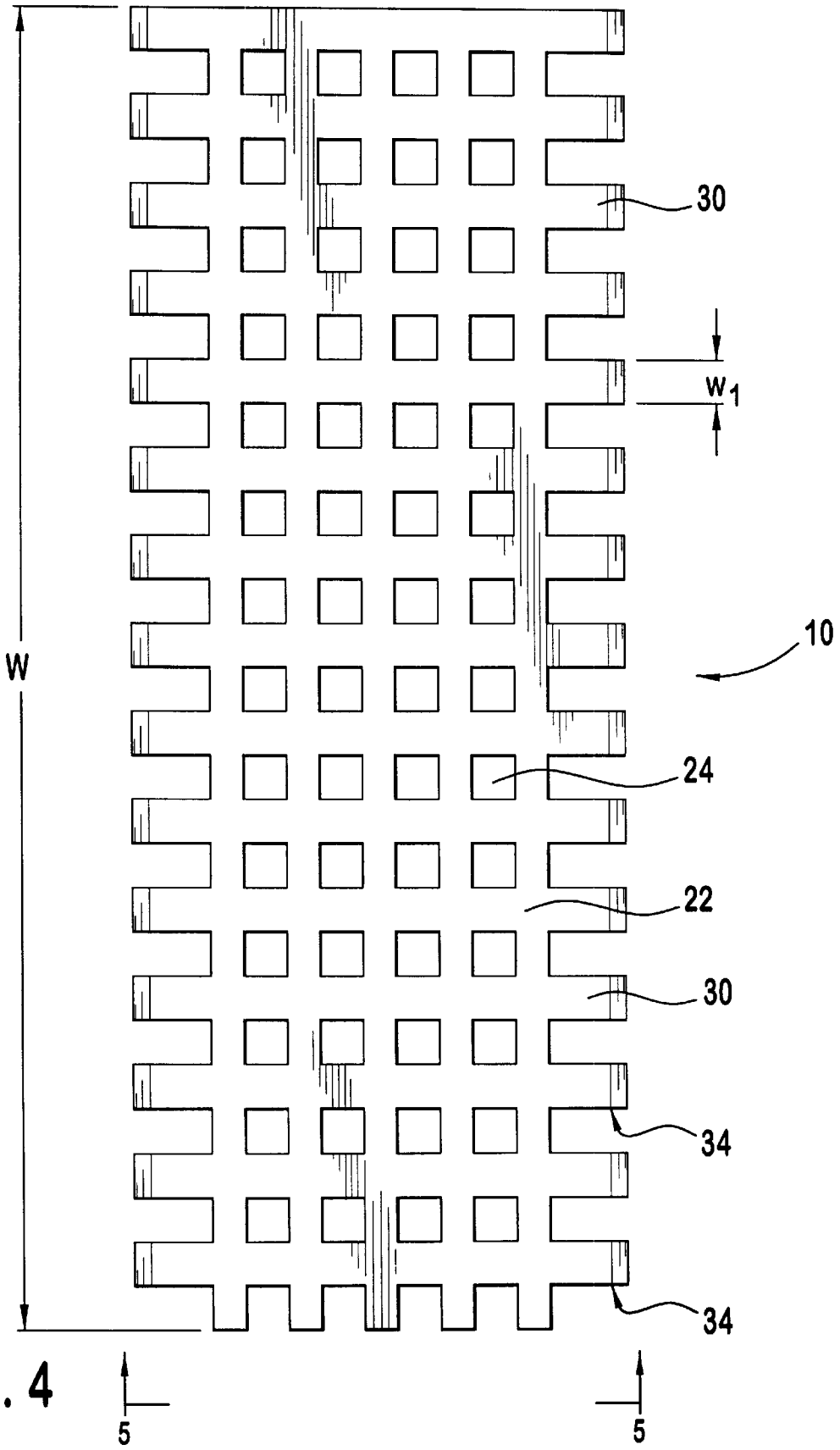
FIG. 4 is a top or sheet side plan view of a link base of the present invention.
Figure 5:
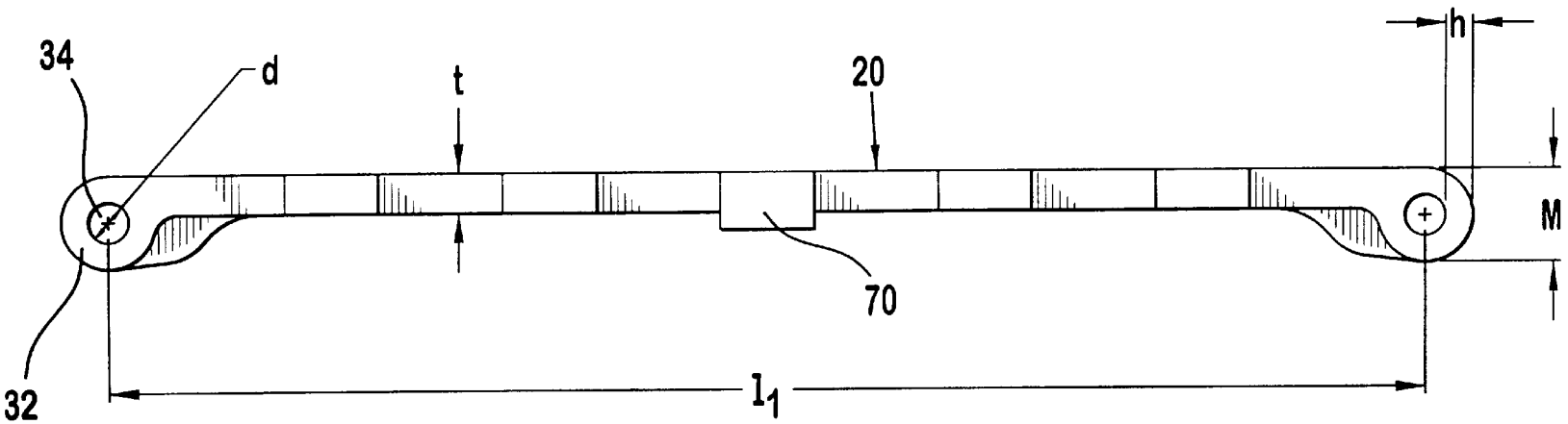
FIG. 5 is an end view of a link base of the present invention as seen along line 5—5 of FIG. 4.

The link base was molded with a 6 inch (15.2 cm) major axis and a 2 inch (5.1 cm) minor axis. The three-to-one ratio of major axis to minor axis is believed to aid mold processability. Open area was established on the link base by a gingham-like pattern defining rectangular or squared openings. As shown in FIGS. 4 and 5, the link base thickness t was established at 0.060 in. (1.5 mm) with a 0.090 in. (2.3 mm) runner 70 centrally located parallel to the major axis, to help flow during molding. A maximum thickness M of 0.143 in. (3.6 mm) is found at each side parallel to the major axis due to the bearing thickness h, 0.040 in. (1.0 mm), surrounding the pintle hole diameter d, 0.063 in. (1.6 mm). A minimum pintle hole diameter was calculated based on an individual pintle link width w of 0.200 inch (5.1 mm). A minimum 0.044 inch (1.1 mm) diameter was calculated for a stainless steel pintle because a nylon pintle yielding the desired load capacity exceeded thickness requirements. The specific diameter, 0.063 in. (1.6 mm), was chosen for tooling reasons; it is sized to receive a 0.0625 inch (1.59 mm) diameter pintle.

The resultant weight was calculated from measured volume of the link, 0.56 in.$^3$ (9.18 cm$^3$), and known specific gravity of nylon 6/6 (1.14) to be 0.023 pounds (10.4 gm) per link. Each link has an area of 6 in. (15.2 cm)×2 in. (5.1 cm) or 12 in.$^2$ (77.5 cm$^2$) resulting in a weight per area of 0.0019 pounds per square inch (1.34 kg/m$^2$), as compared to existing fabric weight of 0.0025 pounds per square inch (5.9 oz./ft.$^2$) (1.8 kg/m$^2$). Thus, the goal of maintaining fabric thickness while reducing weight was achieved.

Figure 6:
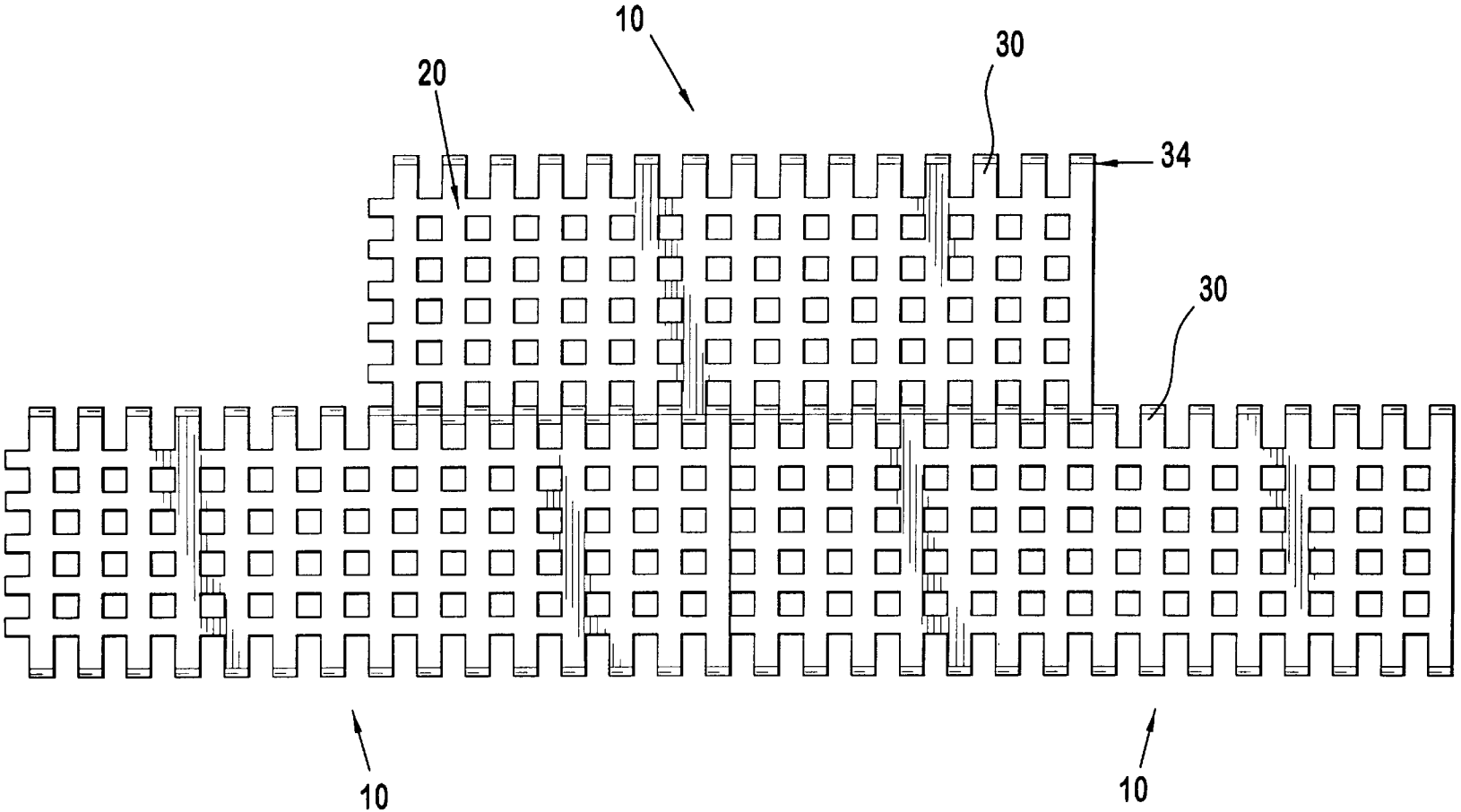
FIG. 6 is a top or sheet plan view of a plurality of interconnected link bases of the present invention.
Figure 7:
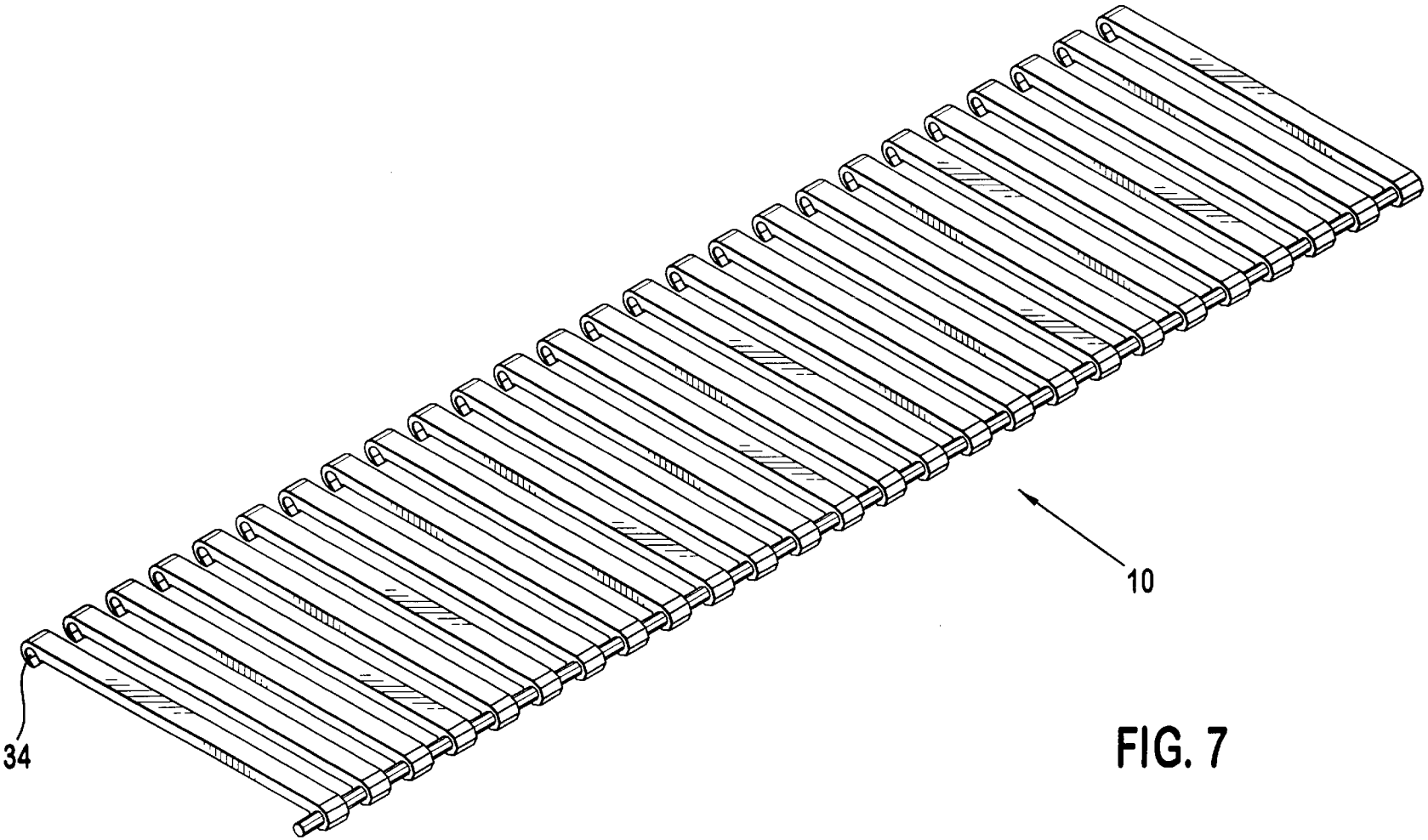
FIG. 7 is a perspective view of an alternative link base of the present invention.
Figure 11:
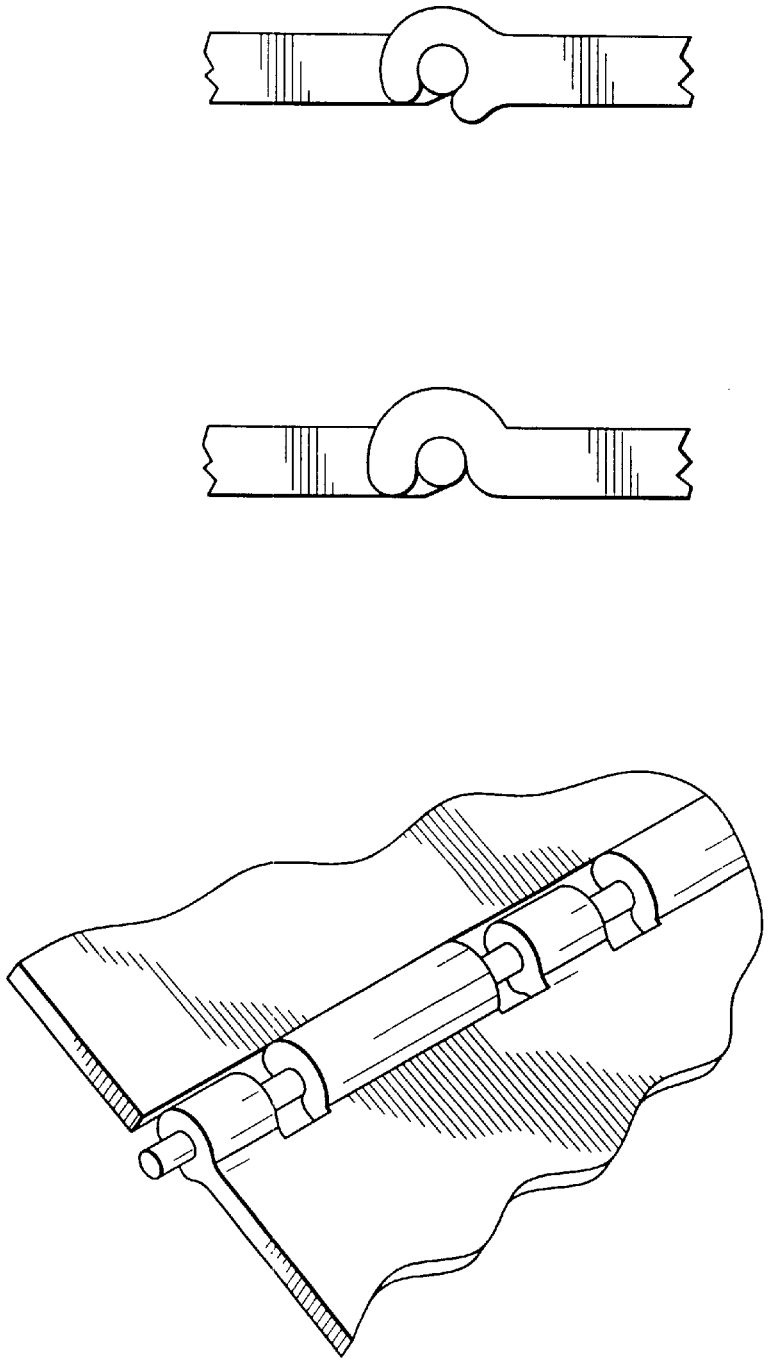
FIG. 11 is a perspective view of a snap support system for interconnecting the subassembly links of the present invention.
Figure 12:
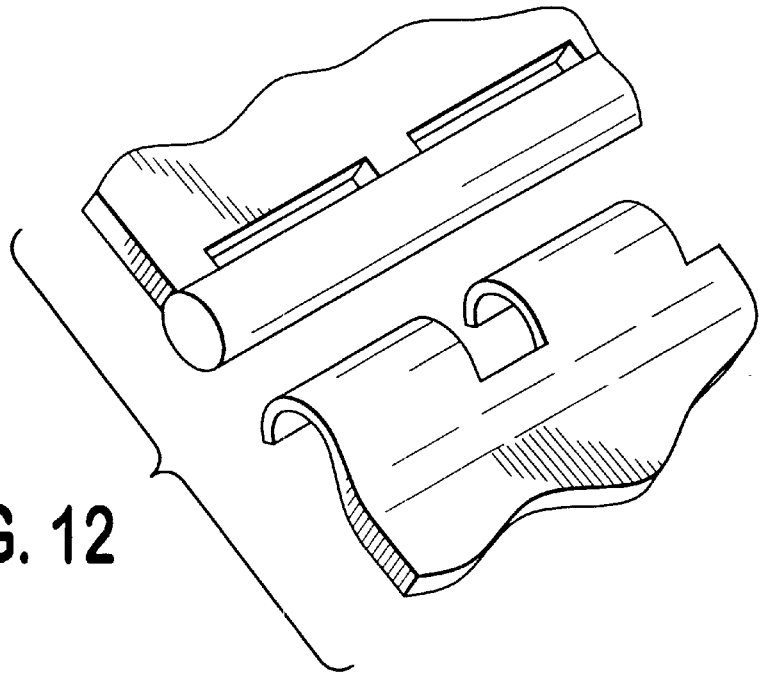
FIG. 12 is a perspective view of a finger lock system for interconnecting the subassembly links of the present invention.
Figure 13:
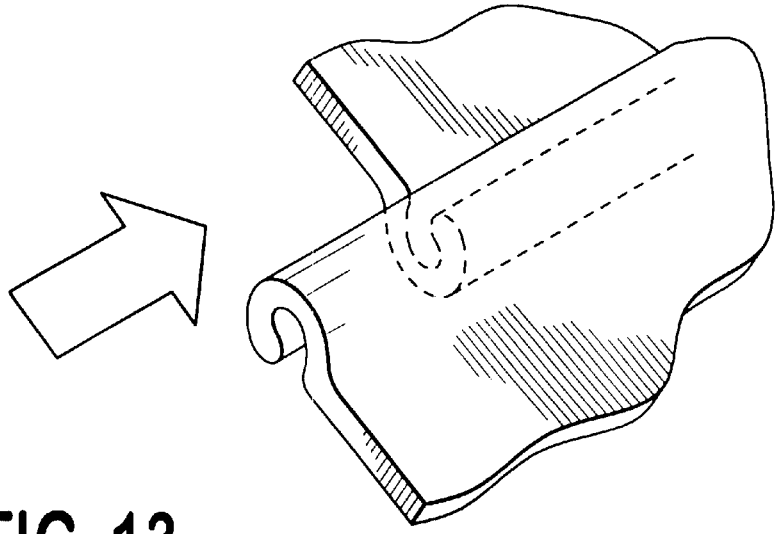
FIG. 13 is a perspective view of a grip linkage system for interconnecting the subassembly links of the present invention.
Figure 14:
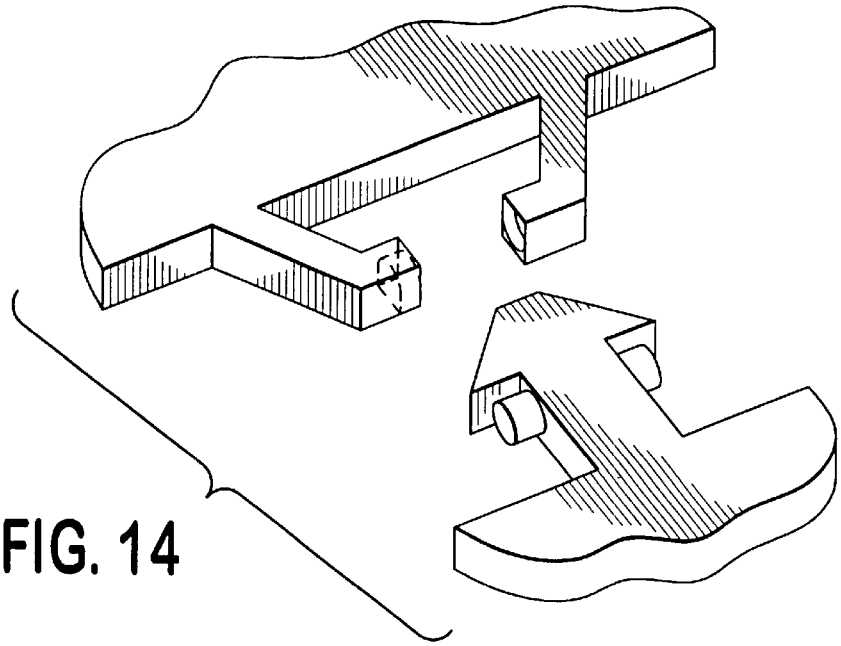
FIG. 14 is a perspective view of a snap-lock system for interconnecting the subassembly links of the present invention.
Figure 15:
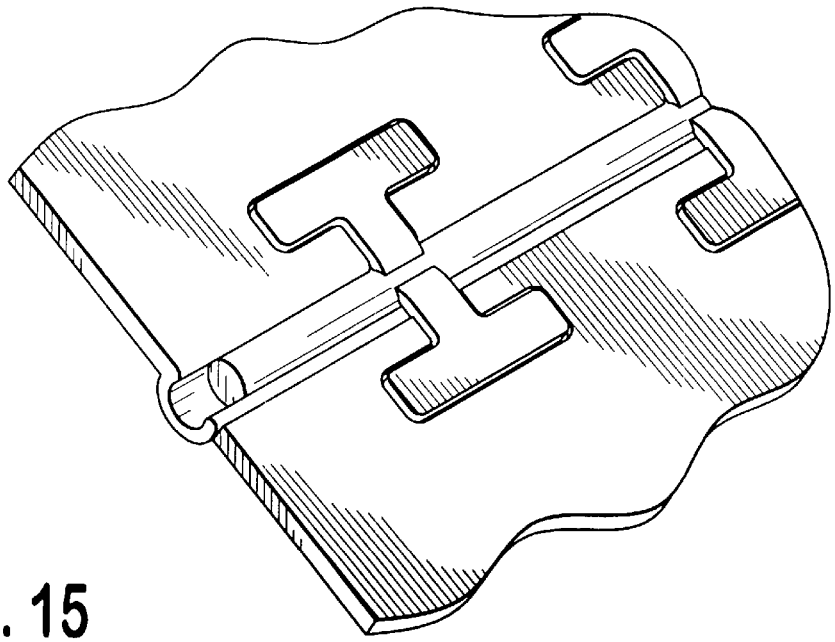
FIG. 15 is a perspective view of a pin for interconnecting the subassembly links of the present invention.

A molded fabric establishes open area and permeability just as the weave of a traditional fabric, but without the concerns over shifting yarns and fabric stability. Although the link base 10, shown in FIGS. 3–6 has a gingham-like "weave pattern" with rectangular or squared openings, circular, oval, or other shaped openings and patterns may also be employed. Because of the molded nature, even three dimensional shapes may be made in the links for desired results, such as permeability, flow control, etc. In fact, link bases may be made using material only in the machine direction as seen in FIG. 7. Fabric stability and paper marking must be considered when designing a link and a modular papermaking fabric just as in traditional fabric design.

Link bases alone may be assembled into a complete fabric, but fabric characteristics are further enhanced or adjusted through use of a second modular component attached to the upper surface of the link base as shown in FIGS. 1 and 2. The combination allows for new open area configurations, altered permeability, differing drainage patterns, and different surface treatments.

A separate, planar surface plate 100 is molded of the same, or complimentary, material as the link base 10, depending upon desired results. As in the link base 10, the surface plate 100 is provided with any of a wide variety of surface characteristics including open area, permeability, surface finish, "weave pattern", etc. It is the combination of these characteristics in the link base 10 and the surface plate 100 that determine final paper characteristics and quality.

The surface plate 100 is attached directly to the subassembly link base 10 via appropriate means including adhesives, ultrasonic welding, or, more preferably, through removable means such as snap-locks or even pintle mounts. When removable, the surface plate 100 may be changed or removed without dismantling the entire fabric constructed of link bases. The surface plate 100 may be replaced, or simply removed to expose the surface characteristics of the base fabric as the sheet side carrier.

In making a complete fabric, a plurality of the bi-component links are interconnected. Fabrics constructed from the bi-component modular links are not limited in dimension by loom size as in traditional fabrics. A fabric of any size can be made by interconnecting the appropriate number of subassembly links. Preferably, a brick layered pattern, as shown in FIG. 6, will be used to increase the fabric strength. In such an arrangement, each link base 10 is staggered so that the individual pintle link 30 intermeshes with the pintle links 30 of two other link bases 10. Accordingly, some reduced size links may be necessary at the fabric edges and in the final seam. Alternatively, this can be accomplished at the edges through simple straight cuts. Similarly, smaller links can be molded to fill a variety of sizes that may be needed to complete the final fabric seam. Preferably, however, the overall fabric length needed will be considered when establishing link dimensions, so that special links of fractional dimensions will not be required to close the final seam.

Calendar finishing may be used on each link on either or both the link base 10 and the surface plate 100, much as in traditional fabrics. For the most uniform treatment, an assembled fabric will be subjected to the finishing treatment. For a more unique fabric, individual links can be given different surface finishes prior to assembly. When the link base and the surface plate have different finishes, the surface plate component may be removed from the fabric to reveal a "new" base fabric surface.

The modular design of the fabric allows for easy replacement of individual sections of the fabric. When one section of the fabric becomes damaged, worn, or dirty, it may be replaced without having to remove and replace the entire fabric. This feature alone will result in a significant cost savings over traditional papermaking fabrics. Additionally, modular papermaking fabrics are strong, stable, versatile, light-weight, easy to install, and easy to repair or replace.

What is claimed is:

1. A multilayered papermaking fabric for use in a papermaking machine, the fabric having an upper surface adapted to support a paper web and a lower surface adapted to contact at least a portion of the papermaking machine, the fabric being comprised of a plurality of modular, molded, pliable, generally rectangular subassemblies each having a major axis oriented in a cross-machine direction of the fabric and having a minor axis oriented in a machine direction of the fabric, each subassembly comprising at least one surface component (100) and a base component (10), the base component (10) having a generally planar upper support surface (20), and a lower surface defining a bearing area (32), the at least one surface component (100) being disposed on the base component (10) and having a generally planar surface adapted to support the paper web, the subassemblies being interconnected to form an endless papermaking fabric, wherein a first layer is formed by the base components (10) and a second layer is formed by the surface components (100), the base components (10) have a first plurality of apertures, the surface components (100) have a second plurality of apertures and a desired surface characteristic on the generally planar surface, a permeability of the fabric being determined by an overlapping alignment of the first plurality of apertures of the first layer relative to the second plurality of apertures of the second layer, the fabric having a tensile strength of at least 8930 kg/m (500 pli) in the machine direction and having the plurality of subassemblies arranged in a brick layered pattern.

2. The fabric of claim 1, wherein the base component (10) of each of the plurality of subassemblies is secured in the fabric solely by pintles.

3. The fabric of claim 2, wherein the base component (10) of each of the plurality of subassemblies is secured in the fabric by at least two pintles.

4. The fabric of claim 1, wherein the base components (10) having the first plurality of apertures arranged in a gingham-like pattern.

5. The fabric according to claim 4, wherein a shape of the first plurality of apertures is any one of a rectangle, a triangle, a square, a diamond, a circle, and an oval.

6. The fabric according to claim 4, wherein a shape of the second plurality of apertures is any one of a rectangle, a triangle, a square, a diamond, a circle, and an oval.

7. The fabric according to claim 3, wherein the base components (10) are formed from a molded polymeric resin and by the pintles are formed from a stainless steel.

8. A fabric according to claim 7, wherein the molded polymeric resin is nylon 6/6.

9. A fabric according to claim 1, further comprised by at least a portion of the surface components (100) comprising a surface finishing treatment.

10. A fabric according to claim 9, further comprised by at least a portion of the surface components (100) comprising a calender finish.

11. A fabric according to claim 1, wherein the surface components (100) are attached to the base components (10) by an adhesive.

12. A fabric according to claim 1, further comprised by the surface components (100) being attached to the base components (10) by ultrasonic welding.

13. A fabric according to claim 1, wherein the surface components (100) are detachably connected to the base components (10).

14. A fabric according to claim 13, wherein the surface components (100) are detachably connected to the base components (10) by a snap-lock.

15. A fabric according to claim 13, wherein the surface components (100) are detachably connected to the base components (10) by a pintle mount.

16. A fabric according to claim 7, wherein the base components (10) and the surface components (100) are formed of the same molded polymeric resin.

17. A fabric according to claim 7, wherein the base components (10) and the surface components (100) are formed of different molded polymeric resins.

18. A fabric according to claim 9, wherein a first portion of the surface components (100) have a first finishing treatment that is different from a second finishing treatment applied to a second portion of the surface components (100).

19. A fabric according to claim 1, including at least two layers of surface components (100) arranged in an overlapping fashion such that the fabric has a selected permeability depending on the installed overlapping alignment of the at least two layers of surface components (100) relative to the first plurality of apertures of the base components (10).

* * * * *